US005749149A

United States Patent [19]

Claytor

[11] Patent Number: 5,749,149

[45] Date of Patent: May 12, 1998

[54] METHOD AND APPARATUS FOR DESIGNING QUILTS

[76] Inventor: Nancy A. Claytor, 217 E. Liberty St., York, S.C. 29745

[21] Appl. No.: 666,049

[22] Filed: Jun. 19, 1996

[51] Int. Cl.[6] ..... B43L 13/20; A41H 3/00; A41H 1/00

[52] U.S. Cl. ..... 33/1 F; 33/1 G; 33/12; 33/562; 33/566

[58] Field of Search ..... 33/1 F, 1 G, 1 C, 33/1 B, 1 BB, 1 K, 11, 12, 17 R, 623, 562, 563, 565, 566

[56] References Cited

U.S. PATENT DOCUMENTS

| | | | |
|---|---|---|---|
| 4,053,986 | 10/1977 | Axelrod | 33/12 |
| 5,052,118 | 10/1991 | Beitler | 33/1 B |
| 5,282,317 | 2/1994 | Carter et al. | 33/1 B |
| 5,557,996 | 9/1996 | Reber et al. | 33/562 |
| 5,579,670 | 12/1996 | McCormick | 33/562 |
| 5,638,605 | 6/1997 | Sligar | 33/1 F |

FOREIGN PATENT DOCUMENTS

| | | | |
|---|---|---|---|
| 529509 | 6/1955 | Italy | 33/1 B |
| 590105 | 7/1947 | United Kingdom | 33/1 B |
| 1578521 | 11/1980 | United Kingdom | 33/1 B |

*Primary Examiner*—Christopher W. Fulton
*Attorney, Agent, or Firm*—Clifton Ted Hunt

[57] ABSTRACT

This invention relates to a quilt graphing system that enables a quilter to custom design quilts and appliques. The quilt designing system includes at least one transparent quilt graphing grid and a template. The grid has a plurality of uniform squares with dimensional markings (dots and dashes) on all four sides of each square in the grid. The dimensional markings divide each side of the square into thirds and quarters. So marked, the quilt graphing grid enables the quilt maker to graph in straight lines, extending between the dimensional markings, artwork beneath the transparent grit or artwork graphed directly on the grid. The template is specially designed for use by the quilt maker in marking each square of fabric to correspond with the shape of a specific portion of the selected design, and for cutting the squares of fabric with seams for piecing together the fabric squares to form the selected design.

5 Claims, 12 Drawing Sheets

METHOD AND APPARATUS FOR DESIGNING QUILTS

FIELD OF THE INVENTION

This invention relates to needlework and more specifically to a quilt graphing grid and template that enable a quilter to custom design quilts and appliques.

BACKGROUND OF THE INVENTION

Quilts and appliques are multiple pieces of fabric stitched together to define one or more designs. Some quilts and appliques are finished without a definitive design. The pieces of cloth are sewn together with random lines of stitches (sometimes called "crazy quilts"). No pattern is needed to make a "crazy quilt".

Most quilts are finished with a definitive design. Some designs are passed down from generation to generation. Some designs are created by professional designers and published in magazines or sold in craft stores with detailed instructions describing how the fabric is cut and sewn to implement the design in a quilt or applique.

Few quilt makers are able to create and implement their own design. Those who have the artistic ability to create their own design often lack the expertise to implement it in a quilt. The majority of quilt makers have heretofore been unable to produce a quilt bearing a design they have chosen, such as a child's drawing or a favorite picture.

SUMMARY OF THE INVENTION

The quilt designing system of this invention includes several quilt graphing grids made from translucent or transparent plastic marked to define a plurality of squares. The squares in each of the quilt graphing grids are of a different size than the squares in the other quilt graphing grids. It is intended that the user select the quilt graphing grid with squares of an appropriate size to allow the chosen design to be graphed in good detail when the chosen design is placed beneath the transparent quilt graphing grid.

Only a single quilt graphing grid is illustrated and described, it being understood that all of the quilt graphing grids are alike except for the size of the squares on each sheet and that a description of one sheet will provide a sufficient understanding of all of the quilt graphing grids.

Dimensional markings (dots and dashes) are provided on all four sides of each square in the quilt graphing grids. The dimensional markings divide each side of the square into thirds and quarters (dots for thirds and dashes for quarters). So marked, the quilt graphing grid becomes a transparent foundation for a graph to be produced by the user (the quilt maker).

In practice, a pattern or graph may be created on the quilt graphing grid by drawing straight lines between selected dimensional markers to form the desired design. Alternatively, a selected design may be placed under the transparent quilt graphing grid and the desired pattern can be graphed in short straight lines that extend between proximal dimensional markings in the squares on the quilt graphing grid.

The quilt designing system of this invention includes a specially designed template for use by the quilt maker in marking each square of fabric to correspond with the shape of a specific portion of the selected design, and for cutting the squares of fabric into pieces that correspond with specific portions of the selected design.

DETAILED DESCRIPTION OF THE INVENTION

Preliminary steps in the conventional making of a quilt and in the making of a quilt according to this invention are to select the fabric from which the quilt is to be made and to cut the fabric into squares of a desired size to be pieced together to form the design in the quilt. The squares of fabric usually measure one, one and a half, or two inches as they appear in the quilt, but it is customary in cutting the squares to add an additional ¼ of an inch on each side of the square for piecing together the fabric squares.

The extra ¼ inch portions of the fabric squares provide the seams for stitching together the squares of fabric during piecing. Some of the squares of fabric are subsequently cut into other shapes to conform to the desired design of the quilt before stitching together the individual pieces of fabric to form the quilt.

Figure 4:
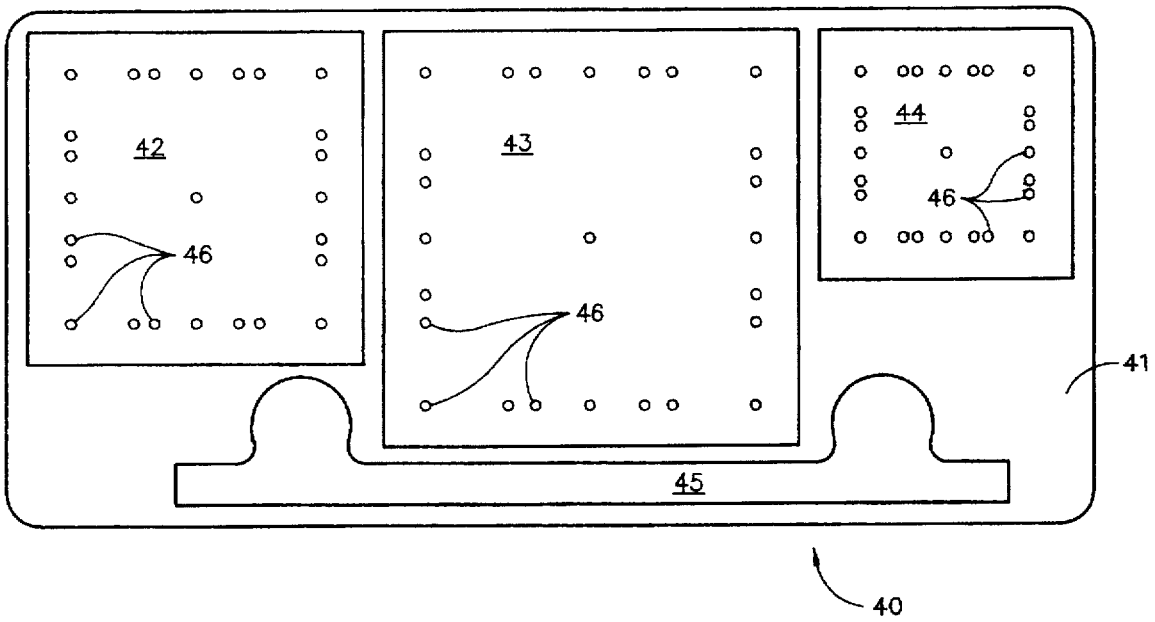
FIG. 4 is a top plan view of a template for measuring and cutting the fabric according to the invention.

The chief distinction of the present invention is that the quilt maker is enabled to make the quilt according to the quilt maker's own design or pattern. The quilt maker does this by selecting a quilt graphing grid 20 with squares of a suitable size from a group of quilt graphing grids 20, each having squares of a different size, and working with portions 42–45 of a template broadly indicated at 40 (FIG. 4).

The Quilt Graphing Grid

Figure 1:
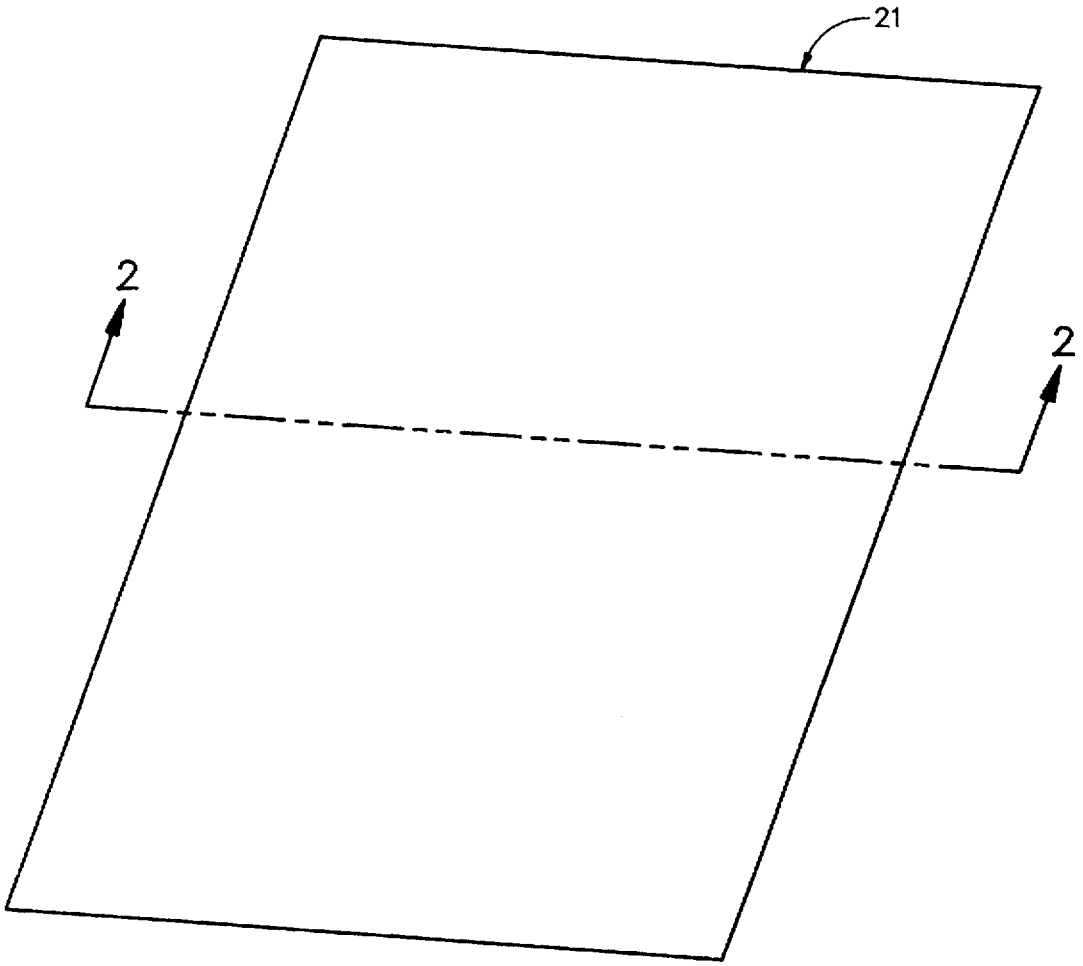
FIGURE 1 (Prior Art)
FIG. 1 is a perspective view of a sheet of prior art transparent plastic, known as drafting film.
Figure 2:
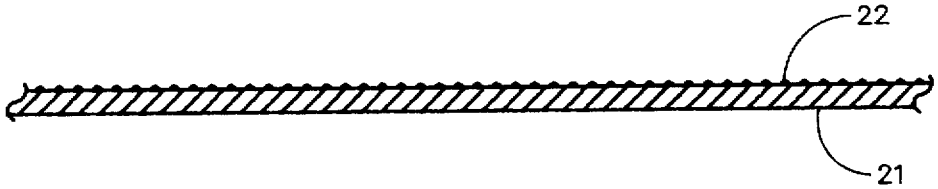
FIGURE 2 (Prior Art)
FIG. 2 is a greatly enlarged sectional view taken substantially along the line 2—2 in FIG. 1, showing the matte finish on one surface of the prior art drafting film.

In the illustrated embodiment of the invention, the quilt graphing grids 20 are made on 8½×11 sheets of prior art transparent or translucent plastic drafting film 21 having a matte finish 22 on one surface, as depicted in FIGS. 1 and 2. A plurality of uniformly sized squares 23 are printed on the matte surface 22 of the drafting paper 21.

A selected grid 20 is based upon squares of fabric which will be stitched together to create the quilt.

Figure 3:
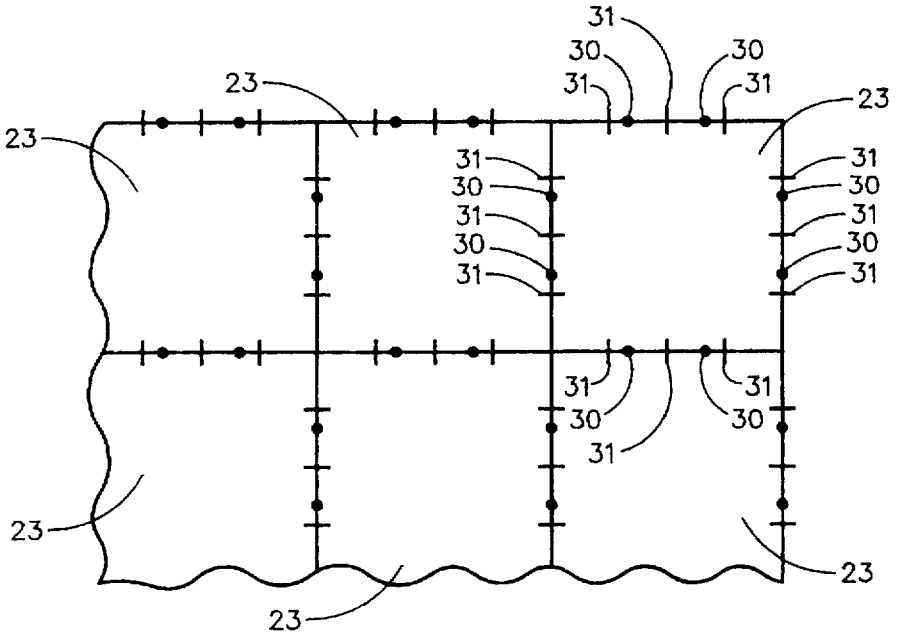
FIG. 3 is a fragmentary top plan view of the prior art drafting film shown in FIGS. 1 and 2, after being printed with squares to form a quilt graphing grid.
Figure 3A:
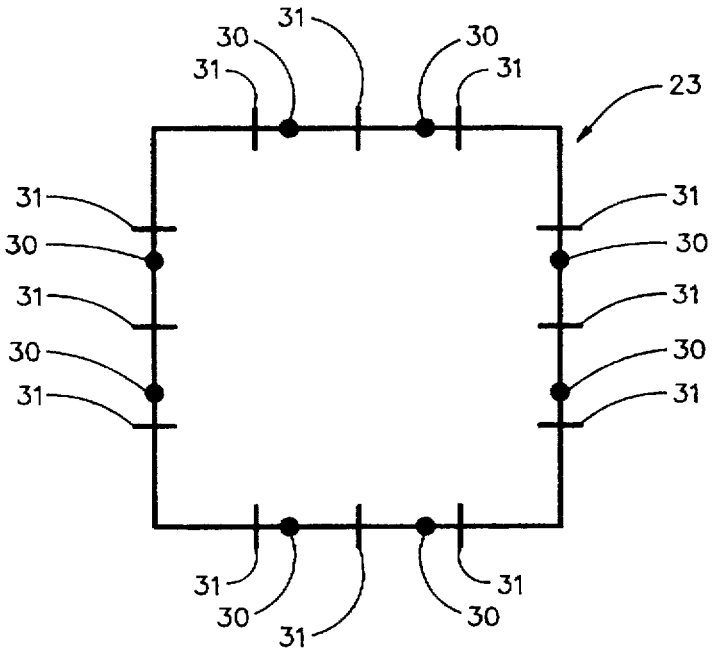
FIG. 3A is an enlarged plan view of one of the squares in FIG. 3.

To facilitate the graphing of a design on the quilt graphing grid 20, the sides of the squares 23 are divided into segments by two dots 30 and three dashes 31 printed on the adjoining sides of the squares 23 (FIG. 3A). The dots 30 are spaced from each other a distance equal to one third of the length of their respective sides of the square. So spaced, the dots divide the sides of the squares 23 into thirds.

The dashes 31 are spaced from each other a distance equal to one fourth of the length of their respective sides of the squares. So spaced, the dashes divide the sides of the squares 23 into quarters.

The dots 30 and the dashes 31 on all four sides of the squares on the grid 20 are used to create the design in the quilt.

It is preferred that the quilt maker be provided with a group of at least three quilt graphing grids 20, and that all grids 20 in the group be alike except for the sizes of the squares. Each grid 20 in the group has squares 23 of a different size than the squares in the other grids in the group. This enables the quilt maker to select a quilt graphing grid with squares of an appropriate size to permit graphing of the chosen art with good detail.

The Template

Figure 5:
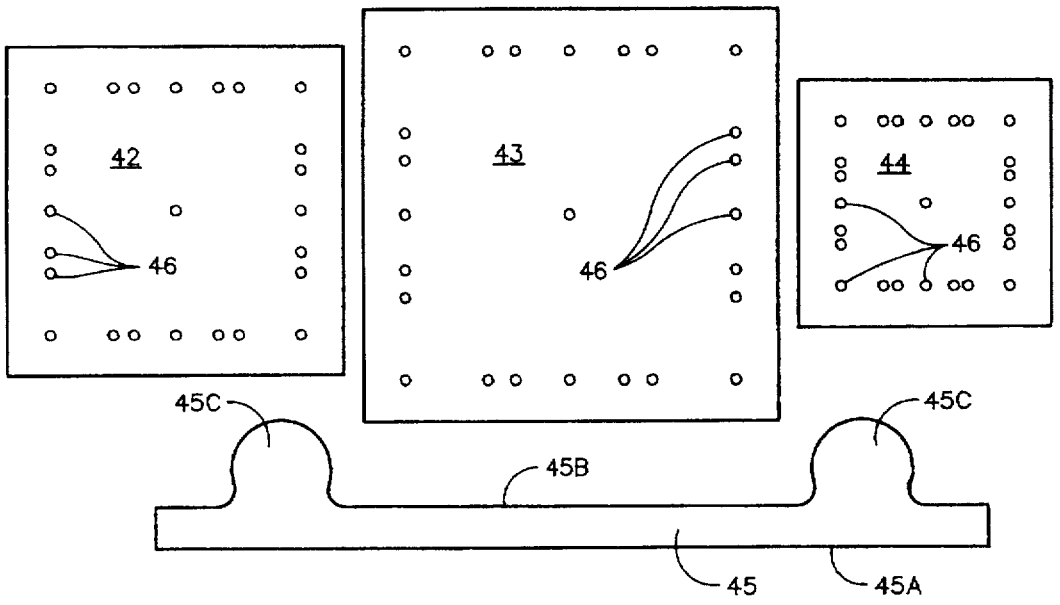
FIG. 5 is a top plan view of the template of FIG. 4, with the three template squares and the straightedge portion of the template broken out for use.

The template 40 is molded from Lucite and comprises a base 41 formed with four breakaway elements indicated at 42, 43, 44 and 45 in FIGS. 4 and 5. The three breakaway elements 42–44 are template squares corresponding in size to the three sizes generally used by quilters for the squares of fabric they piece together to make the quilt. The template squares 42–44 each have inwardly spaced holes 46 corresponding in spacing to the dots 30 and dashes 31 on the sides of the squares 23 on the quilt graphing grids 20.

Figure 7:
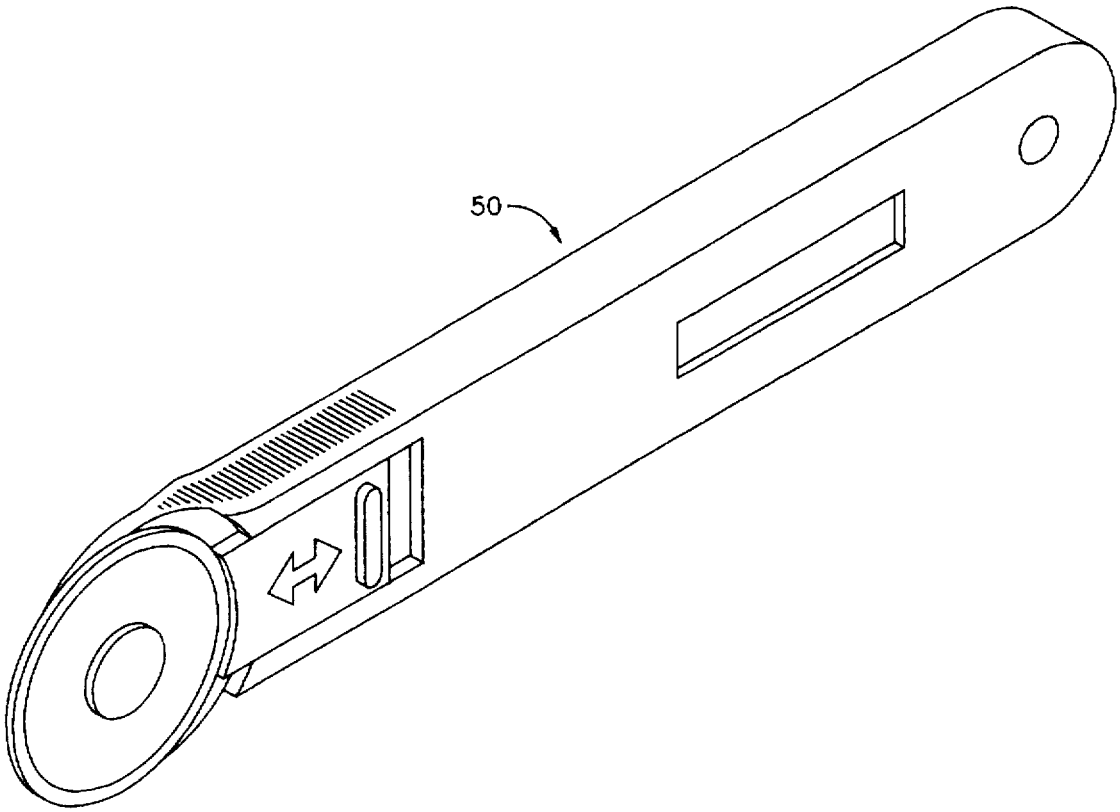
FIGURE 7 (Prior Art)
FIG. 7 is a perspective view of a prior art rotary cutter.

The other element in the template 40 is a straightedge portion 45. As used herein, the term "straightedge" is defined as that portion of the template 40 that is one quarter of an inch (¼") wide for the purpose of adding the standard one quarter inch quilting seam allowance beyond the measured line of cut. The straightedge portion 45 of the template 40 is used when cutting the fabric squares as required to follow the pattern that has been graphed on the grid 20, and provide a quarter inch seam. Preferably, a prior art roller blade knife, indicated at 50 in FIG. 7, is rolled along the edge 45A of the straightedge 45 to cut the fabric. The width of the straightedge 45 provides the ¼ inch seam allowance.

Example of Quilt Making With the Quilt Designing System

Figure 8:
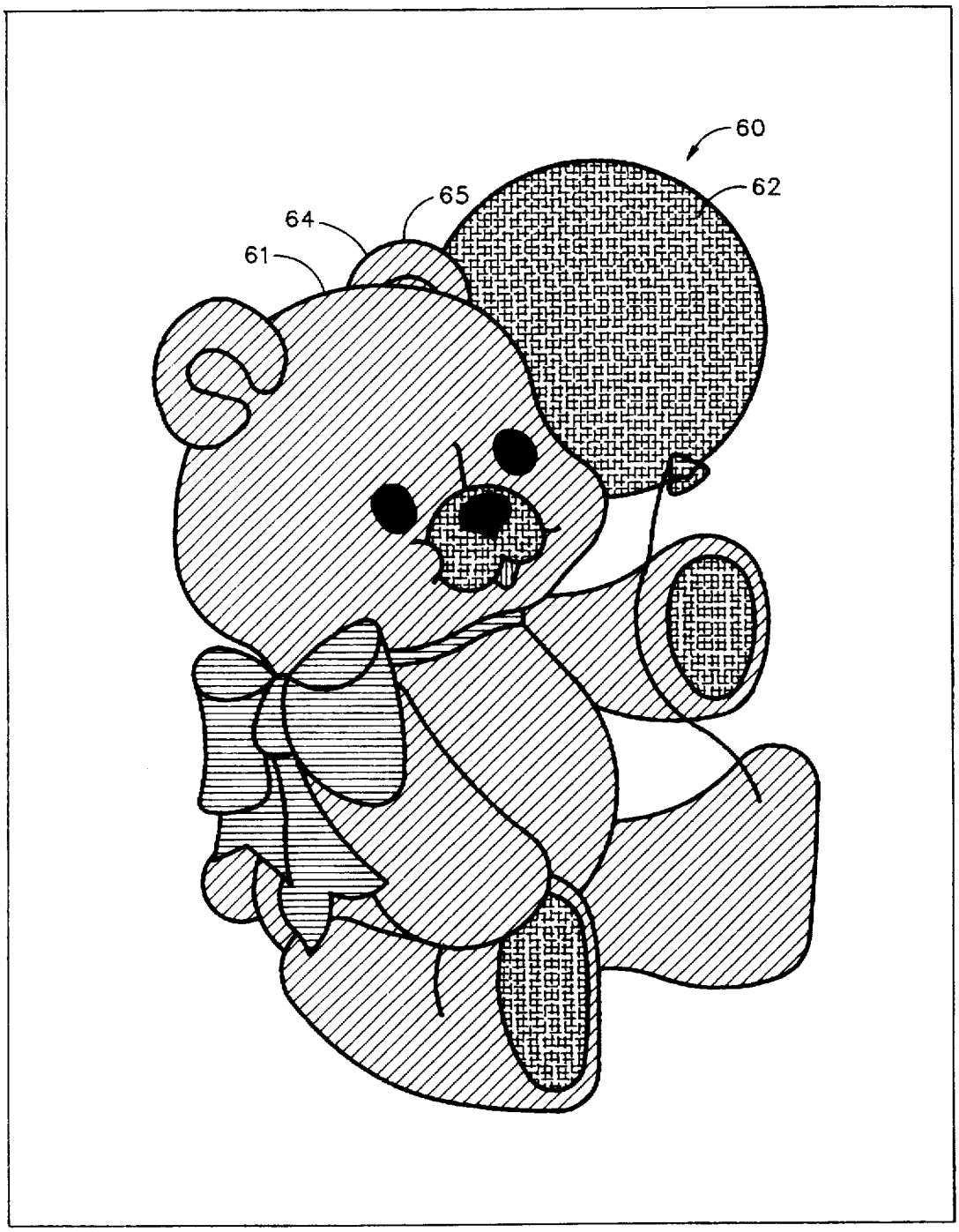
FIG. 8 is a plan view showing an example of a design to be reproduced in a quilt, the hatching illustrating different colors in the design.

FIG. 8 shows a design 60 that a quilt maker has selected for use with the quilt designing system of this invention. The selected design 60 shows a brown bear 61 holding a yellow balloon 62.

The first step in incorporating the design 60 into the quilt to be made is to select the size of the squares of fabric that will have to be cut in the shapes necessary to make the quilt. The next step is to select the quilt graphing grid 20 printed with squares of the best size to graph in detail a chosen design, such as, for example, the design 60.

Figure 9:
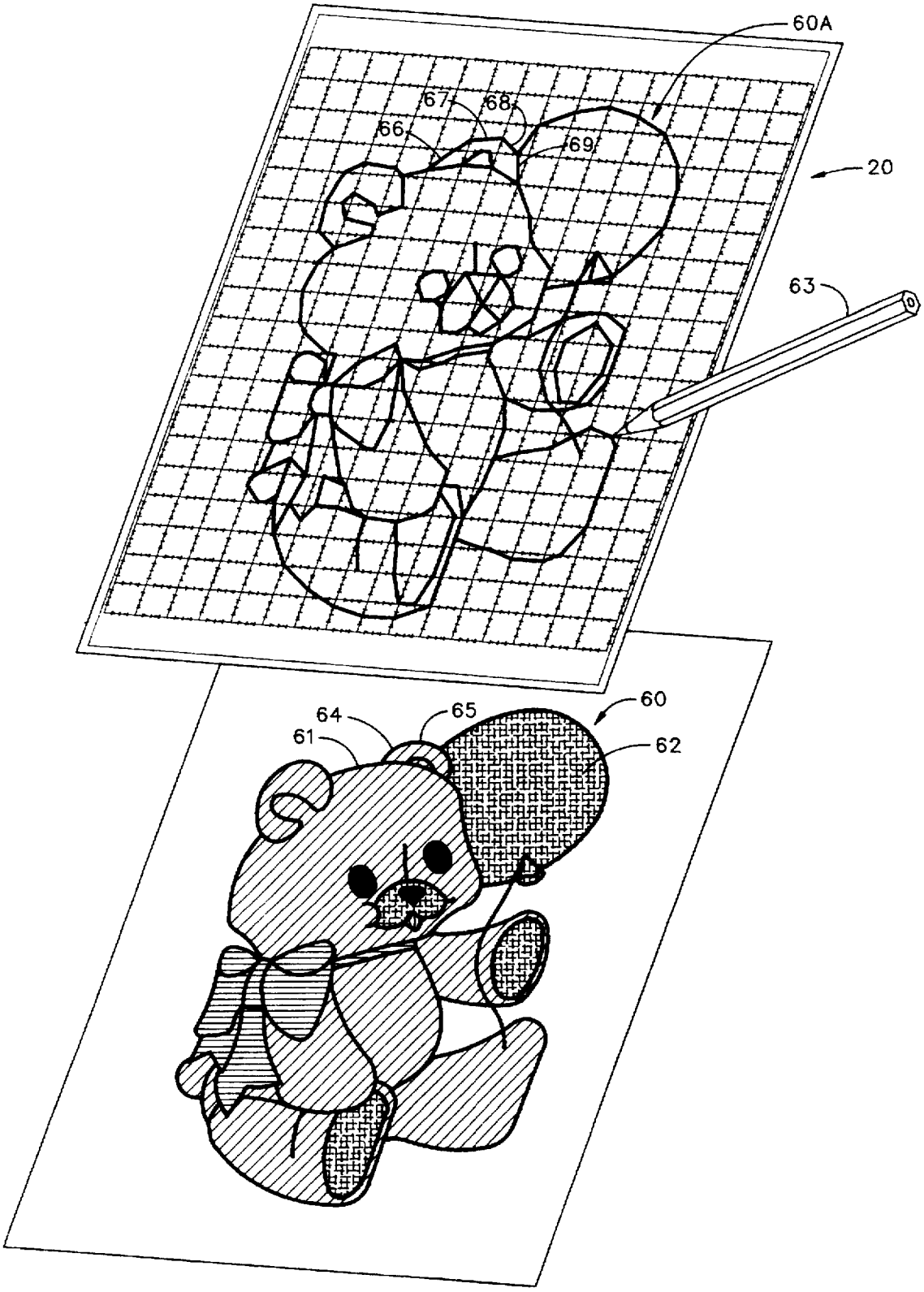
FIG. 9 is an exploded perspective view of the quilt graphing grid shown in FIG. 3 positioned over the design shown in FIG. 8, illustrating the graphing of the design of FIG. 8 on the transparent grid of FIG. 3.

The chosen design 60 is then graphed on the selected size grid 20, as shown in FIG. 9. The grid 20 is placed on the design 60 and a wax and pigment pencil 63 is used to graph the design 60 on the transparent sheet 20. According to the invention, the graphing is not a literal copying or tracing. For example, instead of drawing a round balloon and rounded ears as shown in FIG. 8, the ears and balloon are drawn with a series of short straight lines extending between the dots 30 and the dashes 31 in the sides of the squares 23 on the grid 20. The straight lines that are drawn on the quilt graphing grid 20 extend between those dots and dashes that are closest to the lines in the underlying design 60, as shown at 60A in FIGS. 9 and 10.

Figure 10:
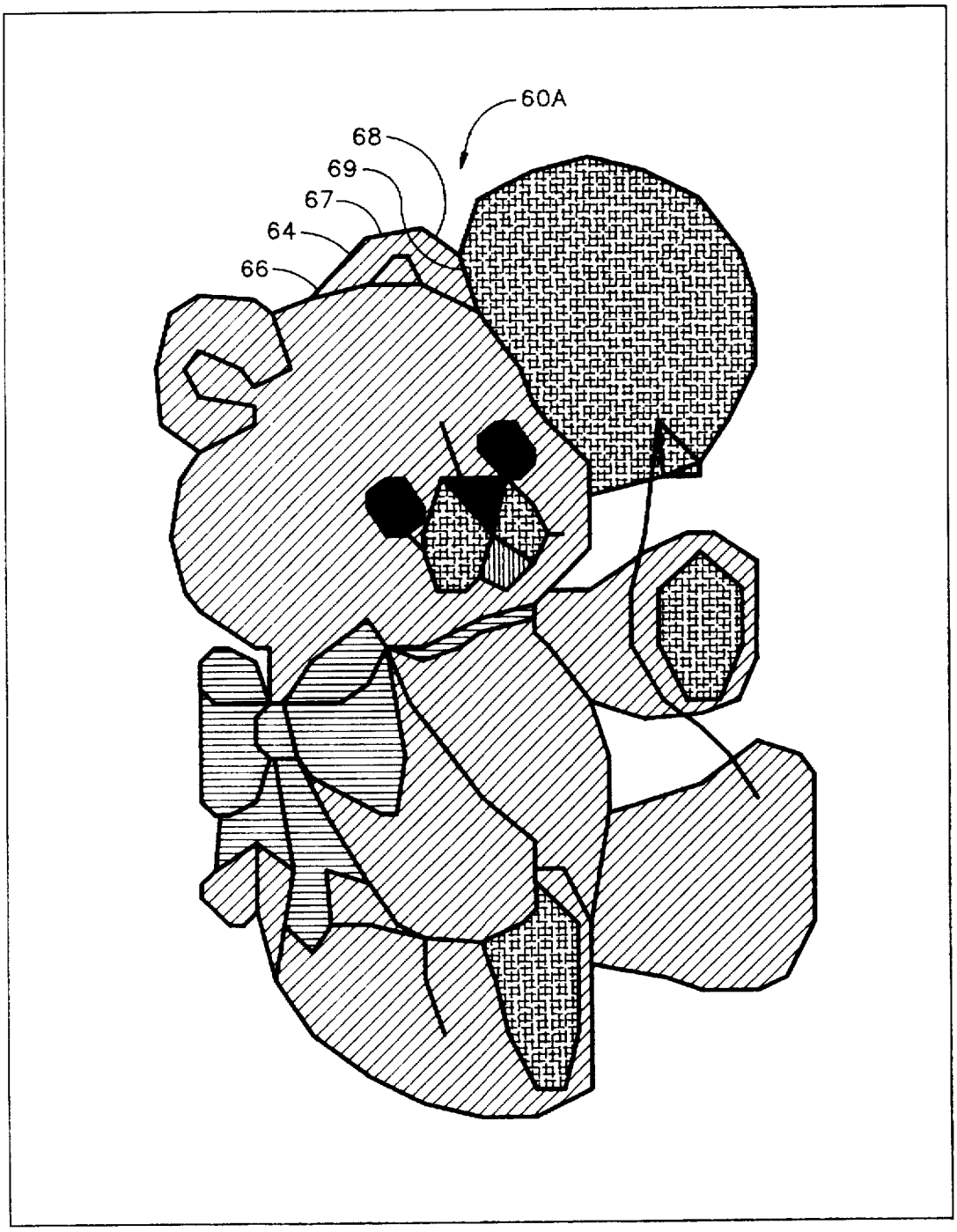
FIG. 10 is a plan view of the design of FIG. 8 as it appears after being graphed on the quilt graphing grid.

As a specific example, the bear's rounded left ear 64, drawn with a single curved line 65 in FIG. 8, appears in four straight lines 66–69 in FIG. 10. The origin of the lines 66–69 appears between proximal dots 30 and dashes 31 on the sides of adjoining squares 23 in the grid 20 of FIG. 9.

Figure 6:
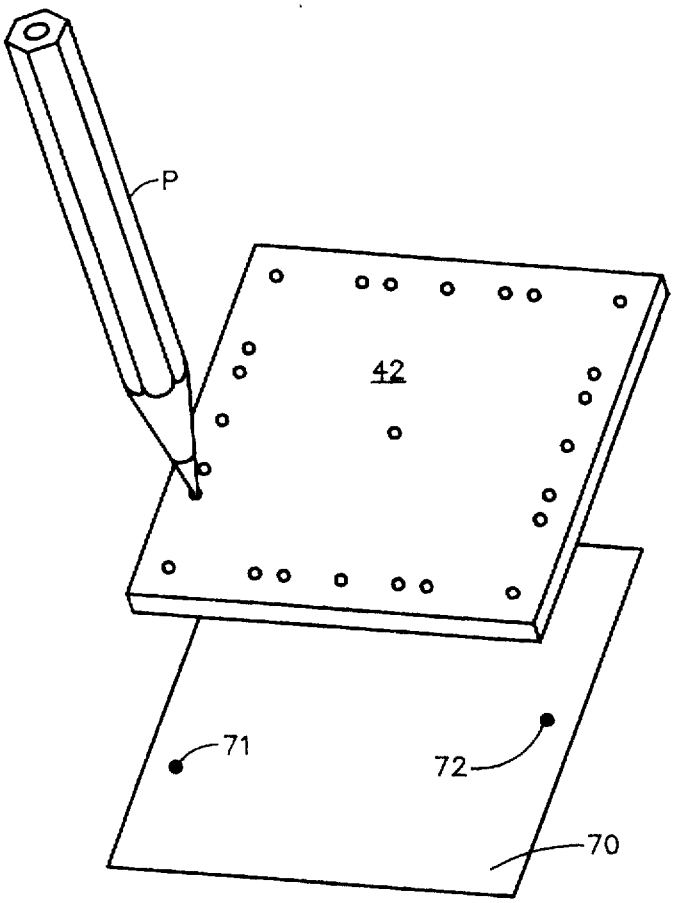
FIG. 6 is an exploded perspective view of one template square operably positioned to mark a square of fabric for cutting to conform with a portion of the graph.
Figure 6A:
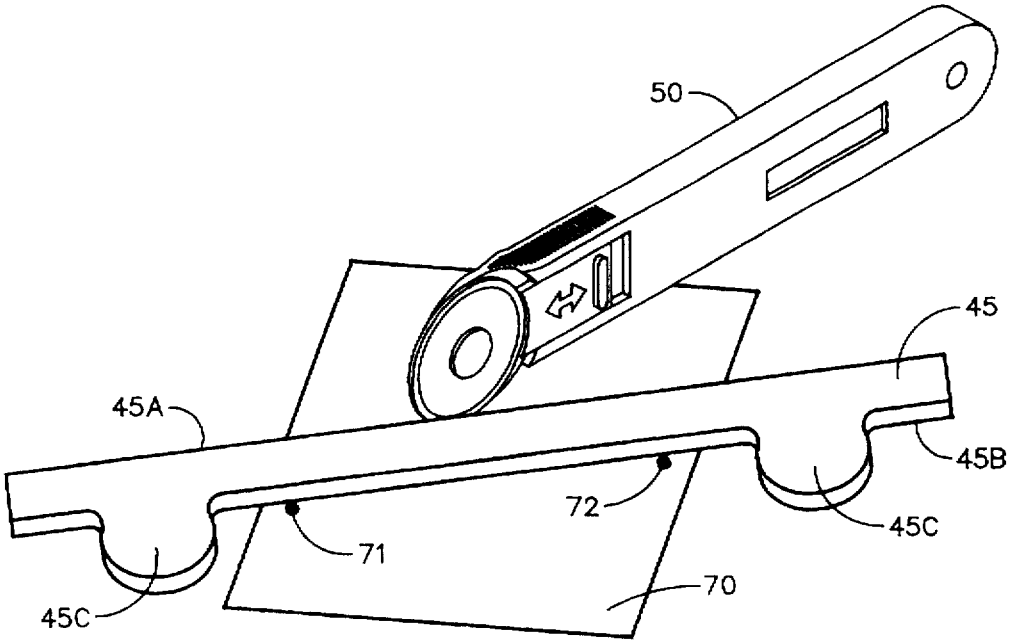
FIG. 6A is a plan view of the straightedge portion of the template operably positioned for use in cutting the piece of fabric according to its marking as shown in FIG. 6.
Figure 9A:
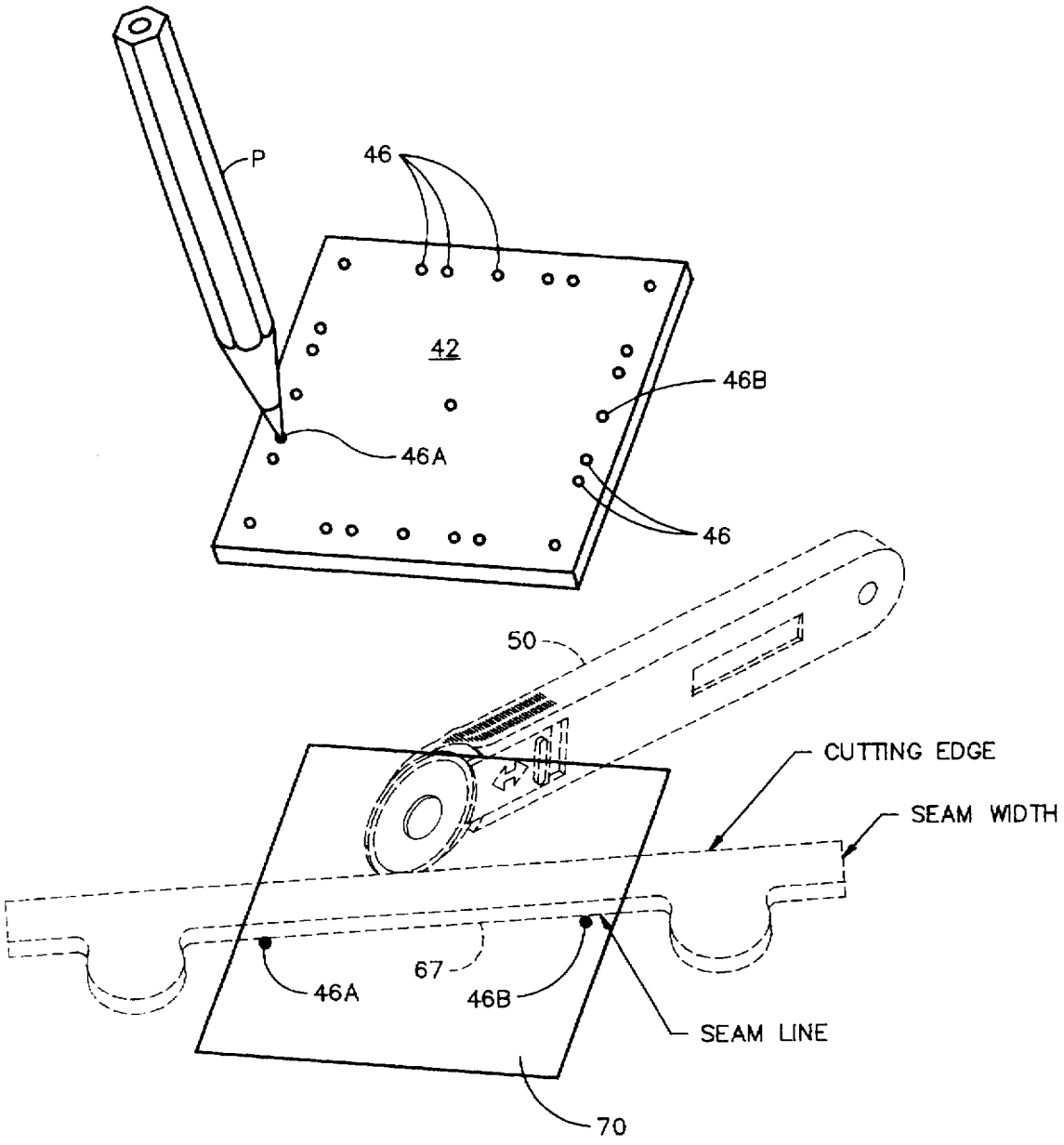
FIG. 9A is an enlarged exploded perspective view illustrating the positioning of a template square selected from the template shown in FIG. 5 on a square of fabric to be marked for cutting, and showing in dotted lines the straightedge portion of the template positioned for cutting the fabric with a rotary cutter to form a portion of the design.

After the design 60 is completely graphed as design 60A on the grid 20, the quilt maker chooses the desired size of template square (42, 43 or 44) to transfer the design 60A to the pre-cut fabric squares, one of which is indicated at 70 in FIGS. 6 and 6A. The transfer of the design from the grid 20 to the fabric squares 70 is visually accomplished by placing one of the template squares over successive portions of the design 60A and visually selecting successive holes 46 in the template square that correspond to dots and dashes on the grid 20. Then, a marking pen 63 is placed through selected holes 46 in the template square to mark the fabric square beneath the template square, as shown in FIG. 9A.

The holes 46 in the template squares are spaced inwardly ¼ inch from the sides of the squares. The template squares are actually half an inch larger than the finished fabric squares 70 will be when pieced in the quilt. The inwardly spaced holes 46 are used to mark the fabric squares for cutting to fit portions of the design while providing ¼ inch seams on the fabric squares for piecing them together.

Functions of the Template

When the design has been finished on the grid 20 and squares of fabric of the quilter's choice have been cut the same size as the selected template square, portions of the design are transferred to individual fabric squares 70.

Referring to FIG. 9A, template square 42 is shown in position over a fabric square designated at 70 that contains the line 67, representing the top of the bear's left ear. The template square 42 is positioned directly over the fabric square 70. So positioned, the quilter marks, as with a pencil P, the holes in the template square that overlie the ends of the line 67. Those holes are designated at 46A and 46B in FIG. 9A. The pencil P is used to mark the portions on he fabric beneath the holes 46A and 46B in the pattern square 42. The marks on the fabric 70 are indicated at 71 and 72 in FIG. 6. The markings 71 and 72 indicate the stitching line.

The straightedge 45 from the template 40 is used in cutting the fabric square 70 along the line defined by the marks 71, 72. One side 45A of the straight-edge 45 is straight and smooth like the edge of a ruler. The other side 45B is spaced ¼ of an inch from the side 45A and is also straight and smooth except for two tabs 45C that extend from the side 45B to be held by the quilter's fingers.

When cutting a fabric square 70 to conform with a portion of the design, the straight-edge 45 is placed over the fabric square with the side 45B extending along the stitching line defined by the marks 71, 72, as shown in FIG. 6A, Located in this manner, the side 45A of the straight-edge 45 is spaced ¼ of an inch beyond the marks 71, 72. The side 45A defines the actual line of cut, as by the rotary cutter 50, and the extra fabric that is provided by the ¼ inch spacing between the sides 45A and 45B is used in piecing together the fabric squares 70 to form the design 60.

Figure 11:
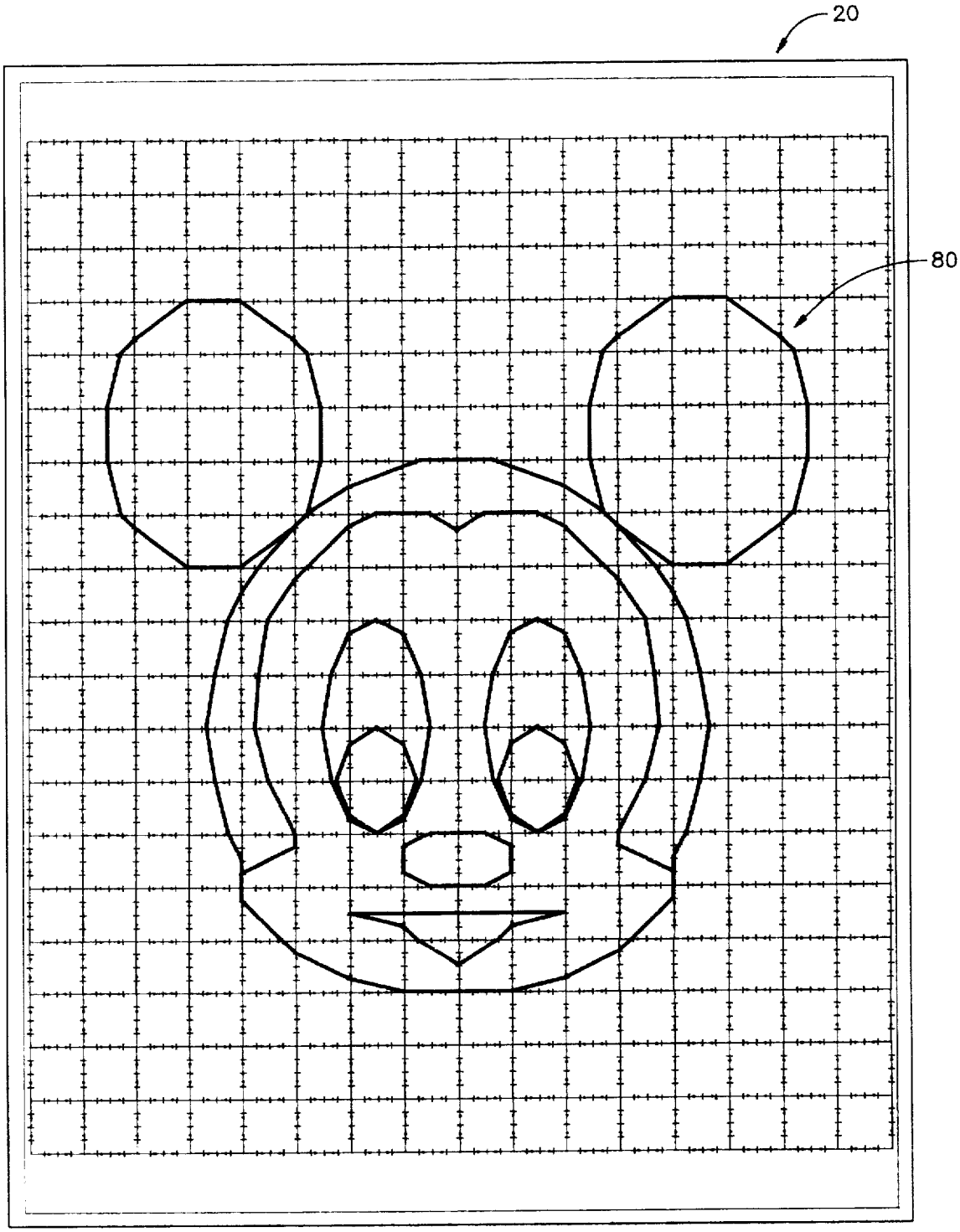
FIG. 11 is a plan view illustrating a design graphed on the quilt graphing grid, with no design beneath the grid.

FIG. 11 illustrates the drawing of a graph 80 in the form of a desired design directly on a quilt graphing grid 20 without the need for tracing it from an existing design as described in connection with FIGS. 8 and 9. The graph 80 is formed with straight lines extending between selected dots 30 and dashes 31 in the squares 23 on the quilt graphing grid 20. One of the template squares 42–45 and the straight-edge 46 is used in marking and cutting the fabric squares 70 in the same way as heretofore described.

Figure 12:
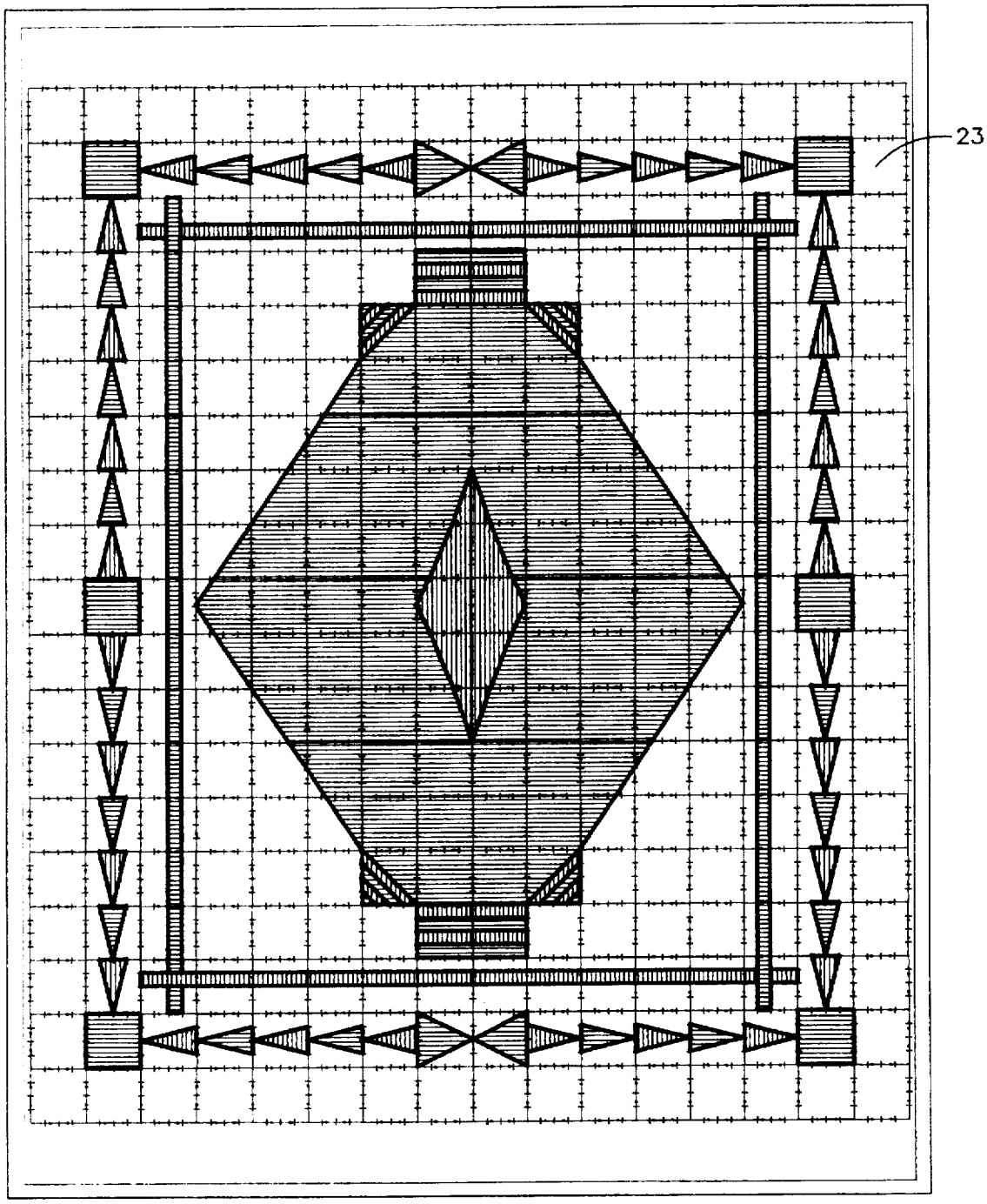
FIG. 12 is a plan view illustrating the use of a quilt graphing grid to create a geometric quilt pattern, the hatching illustrating different colors in the design.

FIG. 12 illustrates the designing of a geometric quilt. Any two points (dots 30, dashes 31 and the corners of the squares 23) may be joined for this purpose.

Figure 13:
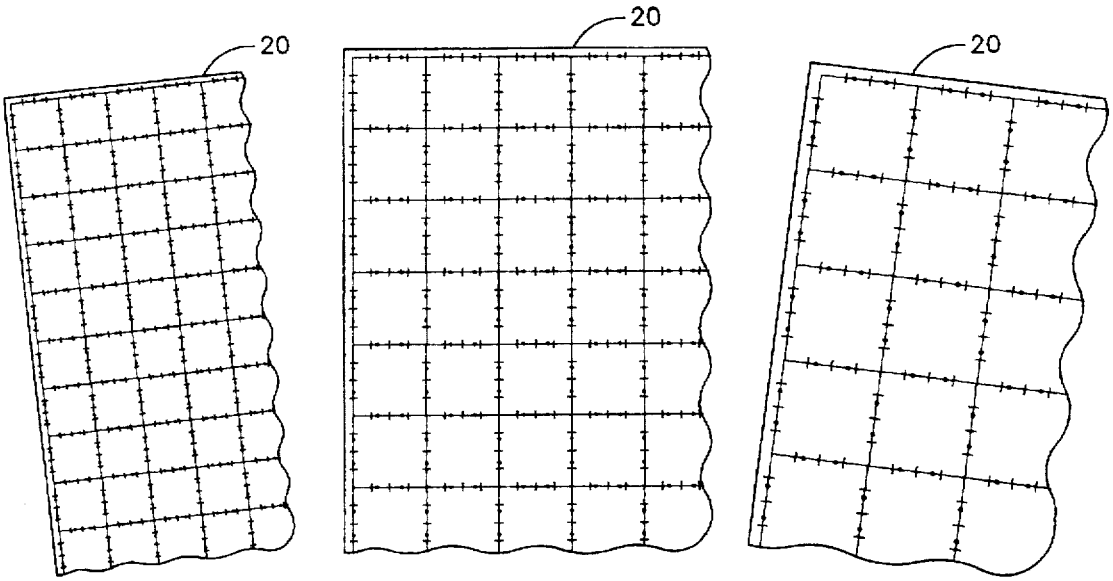
FIG. 13 is a perspective view, with parts broken away, showing the template and a group of quilt graphing grids, each having squares of different sizes, that are provided for use with the graph designing system of this invention.
Figure 13:
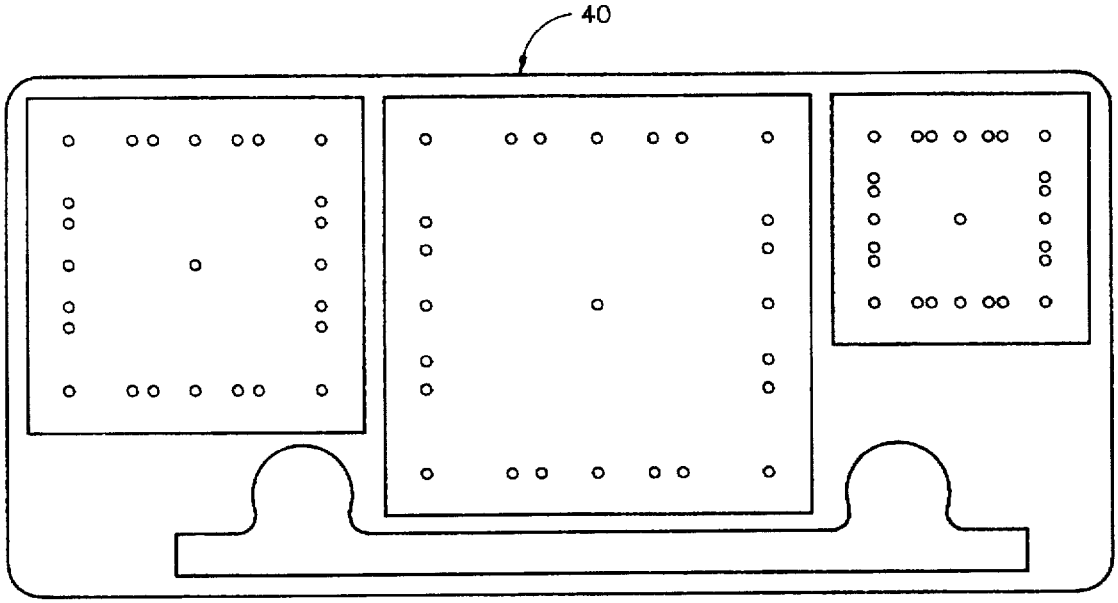

FIG. 13 illustrates those tools provided by this invention for designing a quilt with the graph designing system of this invention. Those tools consist of the template 40 and a group of quilt graphing grids 20 (preferably three grids), each grid in the group having uniform squares that are of a different size than the squares in the other grids in the group.

There is thus provided the tools and resources needed to enable quilt makers to make graphs or patterns according to their own designs.

I claim:

1. Apparatus for use in a quilt graphing system that enables a quilter to custom design quilts having fabric squares pieced together with seams to form a design, said apparatus comprising:

(a) at least one quilt graphing grid comprising a sheet of transparent plastic drafting film having a matte finish on one surface and including a plurality of uniformly sized squares printed on the transparent film, with different types of dimensional markings applied to all sides of each square in the grid and wherein one type of dimensional marking is a dot that designates a third of the length of their respective lines and another type of dimensional marking is a dash that designates a quarter of the length of their respective lines;

(b) at least one template square of the same size as the fabric squares and having a plurality of holes spaced inwardly from each of its sides and wherein the holes in the template square are spaced from each other with the same spacing as the dots and dashes have from each other on the lines of the squares in the quilt graphing grid, and (c) a straightedge, the straightedge including:

(i) one side for measuring lines of cut in the fabric squares, (ii) a side opposed to said one side for guiding the lines of cut.

2. The invention of claim 1 which includes three quilt graphing grids and each of the quilt graphing grids including a plurality of uniformly sized squares of a different size than the squares in the other two quilt graphing grids.

3. The invention of claim 2 which includes three template squares of different sizes for use with different sizes of fabric squares.

4. The method of graphing a design for a quilt, the design having fabric squares pieced together with seams to form the design on the quilt, said method comprising the steps of:

(a) providing a quilt graphing grid;

(b) graphing a design on the quilt graphing grid;

(c) providing a supply of fabric squares of a selected size and of uniform dimensions;

(d) providing a template square of the same dimensions as the fabric squares;

(e) using the template square to measure lines of cut on the fabric squares that correspond with portions of the design;

(f) providing a pencil and marking the measured lines of cut on the fabric squares;

(g) providing a straightedge; and (h) using the straightedge as a guide to provide seam allowances on the fabric squares while cutting the fabric squares with reference to the measured lines of cut on the fabric squares; and (i) providing the template square with inwardly spaced holes for use in measuring the lines of cut in the fabric squares.

5. The method of graphing a design for a quilt, the design having fabric squares pieced together with seams to form the design on the quilt, said method comprising the steps of:

(a) providing a quilt graphing grid including a plurality of uniformly sized squares with dimensional markings on all sides of the squares in the grid (b) graphing a design on the quilt graphing grid with reference to the dimensional markings;

(c) providing a supply of fabric squares of a selected size and of uniform dimensions;

(d) providing a template square of the same dimensions as the fabric squares and with inwardly spaced holes that are spaced from each other in accordance with the spacing of the dimensional markings on each square in the quilt graphing grid;

(e) using the template square to measure lines of cut on the fabric squares that correspond with portions of the design;

(f) graphing the design with reference to the dimensional markings;

(g) providing a pencil and marking the measured lines of cut on the fabric squares;

(g) providing a straightedge; and (h) using the straightedge as a guide to provide seam allowances on the fabric squares while cutting the fabric squares with reference to the measured lines of cut on the fabric squares.

* * * * *